United States Patent [19]

Cartwright et al.

[11] Patent Number: 4,786,915

[45] Date of Patent: Nov. 22, 1988

[54] ATTENUATION OF MICROWAVE SIGNALS

[75] Inventors: Norman E. Cartwright, Debenham; Miles E. Butcher, Woodbridge, both of England

[73] Assignee: British Telecommunications public limited company, England

[21] Appl. No.: 170,650

[22] Filed: Mar. 16, 1988

Related U.S. Application Data

[63] Continuation of Ser. No. 854,544, Apr. 22, 1986, abandoned.

[30] Foreign Application Priority Data

Apr. 26, 1985 [GB] United Kingdom ..... 8510724

[51] Int. Cl.[4] ..... H01Q 17/00

[52] U.S. Cl. ..... 343/909; 343/753; 343/872; 343/911 R

[58] Field of Search ..... 343/753, 781 P, 781 CA, 343/781 R, 784, 840, 841, 872, 909, 911, 915; 342/1-5

[56] References Cited

U.S. PATENT DOCUMENTS

| | | | |
|---|---|---|---|
| 3,078,461 | 2/1963 | Dwyer | 343/907 |
| 3,295,131 | 12/1966 | Hollingsworth | 343/909 |
| 3,329,958 | 7/1967 | Anderson | 343/753 |
| 3,351,947 | 11/1967 | Hart | 343/840 |
| 3,740,755 | 6/1973 | Grezenback | 343/840 |
| 3,877,920 | 6/1975 | Wright et al. | 342/1 |
| 4,169,268 | 9/1979 | Schell et al. | 343/909 |
| 4,282,530 | 8/1981 | Semplak | 343/872 |
| 4,364,053 | 12/1982 | Hotine | 343/915 |
| 4,439,768 | 3/1984 | Ebneth et al. | 342/1 |
| 4,480,256 | 10/1984 | Wren | 343/909 |

FOREIGN PATENT DOCUMENTS

| | | | |
|---|---|---|---|
| 2269720 | 5/1974 | France . | |
| 2304192 | 3/1975 | France . | |
| 0067945 | 6/1977 | Japan | 342/1 |
| 755011 | 8/1956 | United Kingdom . | |
| 1326210 | 8/1973 | United Kingdom . | |
| 1359266 | 7/1974 | United Kingdom . | |
| 2120858 | 8/1985 | United Kingdom . | |

OTHER PUBLICATIONS

Armed Services Technical Information Agency, Unclassified 97965, Jul. 31, 1957.

*Primary Examiner*—William L. Sikes
*Assistant Examiner*—Doris J. Johnson
*Attorney, Agent, or Firm*—Nixon & Vanderhye

[57] ABSTRACT

It is sometimes necessary to reduce the power of microwave transmissions, e.g. to avoid overloading a receiver or to reduce a transmitter's potential to cause interference. The invention reduces the power by inserting radiation absorbent material into the aperture of the antenna. In the preferred embodiment a membrane of absorbent plastics is stretched across the aperture of the dish reflector.

10 Claims, 2 Drawing Sheets

ATTENUATION OF MICROWAVE SIGNALS

This is a continuation of application Ser. No. 854,544 filed Apr. 22, 1986, now abandoned.

This invention relates to the controlled attenuation of microwave signals and in particular it relates to the control of microwave radio links used for telecommunications.

Microwave radio links may be used to carry signals from one place to another. It is sometimes desirable to be able to reduce the power of the transmitted microwaves either temporarily or permanently. This might be for any one or more of a number of reasons e.g.

(a) to prevent overloading at the receiver of a short link;
(b) to prevent interference into the receivers of other links in the locality;
(c) to prevent interference into more distant receivers;
(d) to check the operating margin of a link on installation or subsequently;
(e) to check the interference susceptibility of a link on installation or subsequently.

Conventional techniques for reducing the power include inserting an attenuator between the transmitter and the antenna, adjusting (either manually or electronically) the attenuation of an attenuator built into the link equipment, and varying the power output of the microwave source. The first method can take an inconvenient time to carry out and may involve breaking an airtight seal to the detriment of the equipment reliability; the second can add considerably to the cost of the equipment which is especially undesirable if only occasional changes of attenuation are required; and the third can be detrimental to the stability and cost of the microwave source.

It is an object of this invention to facilitate the reduction of power, including both long and short term reduction, when this is necessary.

According to this invention the required attenuation is achieved by an addition to the antenna and, in particular, by the insertion into its aperture of a signal attenuation means which is capable of absorbing microwave radiation. Preferably the signal attenuation means reduces the signal strength by at least 2 dB, e.g. 5 to 30 dB. The signal attenuation means preferably takes the form of an absorptive sheet stretched cross the aperture of the antenna. The invention also includes an attenuator comprising signal attenuation means mounted upon attachment means wherein said attachment means is adapted for attachment to an antenna. Preferably the attenuator takes the form of an absorptive sheet stretched across one end of a tubular support member the other end of which is adapted for attachment to the periphery of an antenna.

Four forms of absorptive sheet are suitable, namely:

(i) sheets formed of inherently absorbent materials, e.g. carbon filled polyurethane.
(ii) insulating substrates having high resistive layers deposited thereon, e.g. layers with a resistance of 200 ohms per square.
(iii) Inert substrates supporting a pattern of resistance loaded antenna elements. The radiant energy induces currents in the antenna elements and the resistive load dissipates energy as heat.
(iv) Absorbent coatings, e.g. ECCOSORB coatings applied to suitable substrates. The substrates may be inert or they may be absorptive, e.g. as specified in items (i) to (iii) above. Where the substrate is absorptive the coating serves to increase the attenuation.

The invention will now be described by way of example with reference to the accompanying drawings in which.

Figure 1:
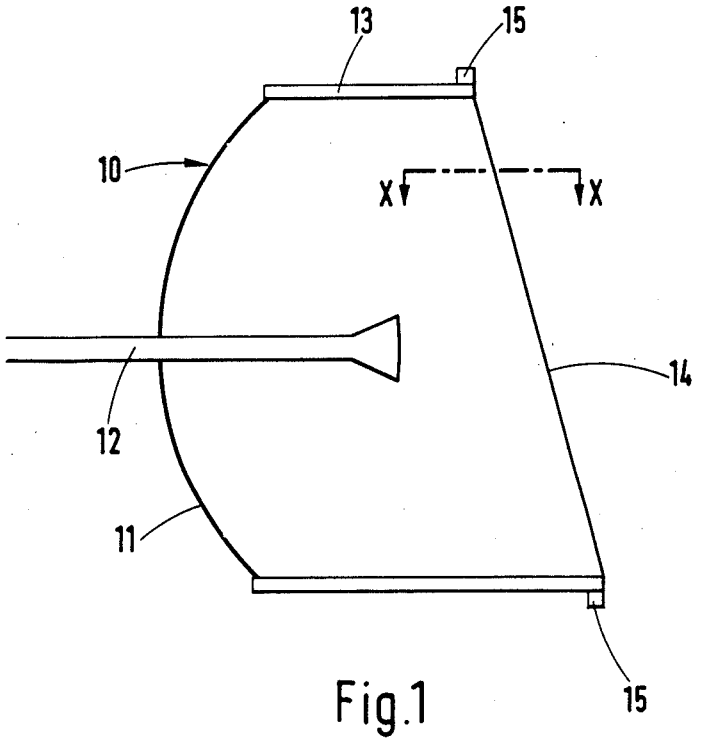
FIG. 1 is a diagrammatic view of a dish antenna incorporating a signal attenuation means in the form of an absorptive sheet.

As shown in FIG. 1, an antenna 10 according to the invention comprises a conventional reflector 11 and a feed 12. An absorptive sheet 14 is stretched across the aperture of the reflector 11. The sheet 14 which is canted at an angle to reduce coherent reflections which sometimes occur, e.g. should the sheet 14 become wet with rain, is supported on extension tube 13 (so that it does not foul the feed 12) being removably fixed by one or more clips or a circumferential hoop 15. The sheet 14, various versions of which are described below, absorbs electromagnetic radiation passing through it and it degrades this energy to heat. This means that, in the transmission mode, the amount of energy radiated to the outside world is less than the amount of energy radiated by the feed 12. In the receive mode the amount of energy reaching the feed 12 is similarly reduced.

(To avoid using a minus sign to denote attenuation we will use the convention that:

$$\text{dB} = 10 \log_{10} Io/I$$

where

Io = power flux density on the incident side of sheet 14, and

I = power flux density on the other side of sheet 14).

The material and/or structure of the sheet 14 is chosen so that it attenuates signals by at least 1 dB. Higher levels of attenuation, e.g. up to 30 dB, may be achieved by using material with inherently higher absorptive properties or by using more of the same material, ie more layers and/or thicker layers. Preferably the sheet 14 is chosen to give an attenuation of between 5 and 25 dB. Dielectric heating is regarded as the preferred mechanism for attenuation. Carbon filled polyurethanes are good compositions having suitable dielectric properties. (Films of such compositions are commercially available, e.g. under the trade name "ECCOSORB").

Figure 2:
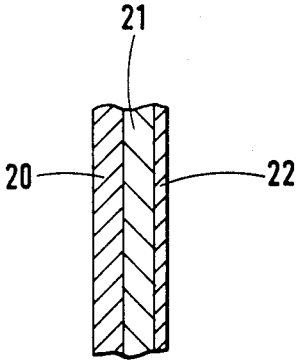
FIG. 2 is a cross section of a first embodiment on line X—X of FIG. 1.

FIG. 2 shows a cross section through a sheet consisting of two absorbing layers, 20 and 21 each of the layers being a film of carbon filled polyurethane. Each of the films is 3 mm thick. Layer 22 is a weather resistant supporting film having little effect upon the electric properties of the antenna. Each of the films is a separate entity so that the number of layers 20, 21 and 22 can be adjusted and arranged to suit the circumstances. A single film (of polyurethane) produces an attenuation of 5 dB and the two layers 20 and 21 as shown produce 10 dB. Thus five films would be needed to give 25 dB.

(As alternatives, not shown, to separate films, laminates or thicker or more absorbent layers could be used.) The layer or layers is/are mounted as shown in FIG. 1.

Figure 3:
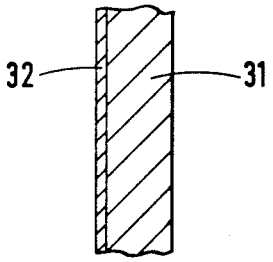
FIG. 3 is a cross section of a second embodiment on line X—X of FIG. 1.

An alternative to the dielectric mechanism, heat dissipation is provided by one or more continuous resistive layers of high sheet resistance, e.g. 200 ohms per square. Such layers are implemented as films of metal, e.g. nickel-chromium alloy deposited on an inert substrate. FIG. 3 shows a cross section through a suitable composite in which a substrate layer 31 supports a metal layer 32; preferably layer 31 is weather resistance. In use the composite is mounted as shown in FIG. 1 and electromagnetic radiation induces random currents in metal layer 32, and because this layer has a finite resistance, heat is produced.

As a third alternative a pattern of dipole antenna elements each with a resistive load is located in the aperture of the antenna. The pattern is implemented by deposition of the required paths on an inert substrate. This third alternative is illustrated in FIGS. 4 and 5.

Figure 4:
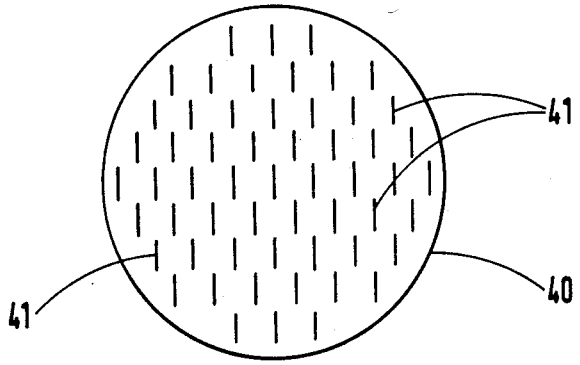
FIG. 4 is a front view of a third embodiment.

FIG. 4 shows a plan of the whole aperture. The absorptive membrane comprises an inert substrate 40 upon which is deposited a pattern of dipoles 41 individually illustrated in FIG. 5). The pattern extends over the whole of the aperture of the antenna. In FIG. 4 each dipole is shown as a single line wherein each line represents the loaded dipole. FIG. 5 shows that each dipole comprises a pair of elements 50 and 51 with a conventional gap between them. The gap is filled with resistive material which provides an electrical connection between elements 50 and 51 (which are conveniently implemented as areas of copper deposited on the substrate 40). Area 52 is conveniently a thin film of nickel/-chromium alloy to act as a resistive load, e.g. about 150 ohms, between the elements 50 and 51. The substrate 40 is mounted across the aperture of an antenna as shown in FIG. 1. A plurality of layers may be so mounted if desired.

Figure 5:
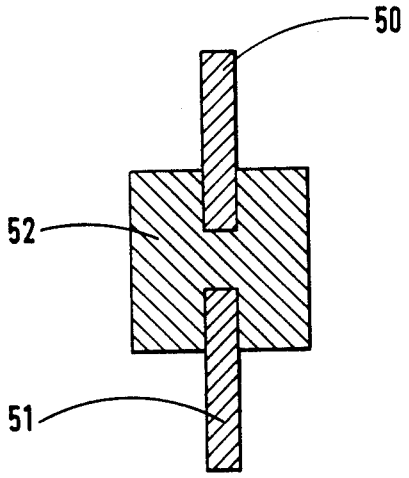
FIG. 5 is a detail of an element of FIG. 4.

In the use of the structure shown in FIGS. 4 and 5 the radiation induces alternating current to flow between elements 50 and 51 of each dipole antenna of the pattern. This current flows via resistive element 52 whereby radiant energy is attenuated by degradation into heat.

We claim:

1. An antenna assembly having an r.f. aperture and which includes removable signal attenuation means which can be situated to cover substantially the entirety of said aperture, said signal attenuation means being adapted to partially absorb electromagnetic radiation so as to partially attenuate the signal by at least 1 dB when it is situated so as to obscure said aperture while permitting the remainder of such signal to pass onward toward a receiving site.

2. An antenna according to claim 1, wherein the signal attenuation means is adapted to attenuate the signal by between 5 dB and 30 dB.

3. An antenna according to either claim 1 or claim 2, wherein the antenna includes a reflective dish and the signal attenuation means takes the form of an absorptive sheet extending across the aperture of the dish.

4. An antenna according to claim 3, wherein the sheet comprises one or more layers of lossy dielectric material.

5. An antenna according to claim 3, wherein the sheet is resistive with a sheet resistance in the range of 10 to 1000 ohms per square.

6. An antenna according to either claim 1 or 2, wherein the signal attenuation means includes an array of resistively loaded dipole antenna elements.

7. An antenna according to claim 6, wherein the resistive loaded dipoles are implemented as conductive areas supported on an inert plastics sheet.

8. An attenuator, suitable for use in an antenna according to any one of the preceding claims, 1 or 2 which comprises attachment means carrying said signal attenuation means wherein said attachment means is adapted for removable attachment to said antenna assembly.

9. An attenuator according to claim 8, which takes the form of an absorptive sheet stretched across one end of a tubular support member the other end of which is adapted for attachment to the periphery of said antenna assembly.

10. A method for controlling the amplitude of electromagnetic radiation of r.f. signals transmitted out of the r.f. aperture of an antenna assembly and onward toward a receiving site; said method comprising the step of:

obscuring substantially all of said aperture with an r.f. absorptive sheet which absorbs a predetermined portion of at least 1 dB of said r.f. signals as they pass therethrough while permitting the remainder of said r.f. signals to pass onward, thereby controlling the amplitude of r.f. signals onward toward a receiving site.

* * * * *